US009689569B2

(12) United States Patent
Vie

(10) Patent No.: US 9,689,569 B2
(45) Date of Patent: Jun. 27, 2017

(54) UNIVERSAL FURNACE CONTROLLER AND METHOD OF INSTALLING SAME

(71) Applicant: Emerson Electric Co., St. Louis, MO (US)

(72) Inventor: David L. Vie, Union, MO (US)

(73) Assignee: Emerson Electric Co., St. Louis, MO (US)

( * ) Notice: Subject to any disclaimer, the term of this patent is extended or adjusted under 35 U.S.C. 154(b) by 366 days.

(21) Appl. No.: 14/528,849

(22) Filed: Oct. 30, 2014

(65) Prior Publication Data

US 2016/0123588 A1 May 5, 2016

(51) Int. Cl.

| | |
|---|---|
| ***F23N 5/24*** | (2006.01) |
| ***F23N 5/20*** | (2006.01) |
| ***F23N 5/26*** | (2006.01) |
| *F23Q 7/24* | (2006.01) |

(52) U.S. Cl.

CPC ..... *F23N 5/242* (2013.01); *F23N 5/203* (2013.01); *F23N 5/265* (2013.01); *F23Q 7/24* (2013.01)

(58) Field of Classification Search

CPC ..... F23N 5/203
USPC ..... 431/18, 71
See application file for complete search history.

(56) References Cited

U.S. PATENT DOCUMENTS 4,971,549 A * 11/1990 Geary ..... F23N 5/123 431/18
5,272,427 A * 12/1993 Nold ..... F23N 5/203 318/102
5,524,362 A * 6/1996 Quandt ..... D06F 39/005 34/526
5,601,071 A * 2/1997 Carr ..... F23N 1/022 126/110 R
6,257,870 B1 7/2001 Hugghins et al.
7,100,382 B2 * 9/2006 Butler ..... F24F 11/008 417/12
7,101,172 B2 9/2006 Jaeschke
8,063,593 B2 11/2011 Mullin
2004/0220777 A1 11/2004 St. Jean et al.

(Continued)

OTHER PUBLICATIONS

White Rodgers/Emerson Climate Technologies, 50M56U-843 Universal Single Stage HSI Integrated Furnace Control Kit Product Manual, 2 pgs.

(Continued)

*Primary Examiner* — Avinash Savani
(74) *Attorney, Agent, or Firm* — Armstrong Teasdale LLP

(57) ABSTRACT

A controller for use in a gas furnace system including a gas valve and an ignition device is provided. The controller includes a circuit board, a control circuit connected to the circuit board, and a plurality of harness connectors mounted to the circuit board. The control circuit is configured to control operation of the gas valve and the ignition device. Each harness connector is configured to mate with a wiring harness to electrically connect the control circuit to at least one component of the furnace system. Each harness connector includes a plurality of pin connectors defining a pin configuration of the corresponding harness connector, and each pin configuration is different than the other pin configurations. At least one pin connector from each harness connector is electrically connected in parallel with one of the pin connectors from each of the other harness connectors.

22 Claims, 4 Drawing Sheets

(56) References Cited

U.S. PATENT DOCUMENTS

2004/0230402 A1 11/2004 St. Jean
2008/0206692 A1* 8/2008 Hsieh ..... F23N 5/203
431/71

OTHER PUBLICATIONS

White Rodgers/Emerson Climate Technologies, 50M56U-843 Universal Single Stage HSI Integrated Furnace Control Kit Installation Instructions, 8 pgs.
Honeywell International Inc., 59200U1000 Universal Hot Surface Ignition Integrated Furnace Control Installation Instructions, 2009, 24 pgs.

* cited by examiner

UNIVERSAL FURNACE CONTROLLER AND METHOD OF INSTALLING SAME

FIELD

The field of the disclosure relates generally to gas-powered furnace systems, and more particularly, to furnace controllers for use in gas-powered furnace systems.

BACKGROUND

Gas powered furnace systems generally include a burner, a gas valve for controlling the supply of gas to the burner, and an ignition device to ignite gas supplied to the burner. Heat generated from the burner is circulated through a heat exchanger, and a circulator blower circulates air across the heat exchanger and into a temperature controlled environment to provide heat to the temperature controlled environment. A furnace controller is often used to control various components of the furnace system to ensure proper operation of the furnace system. Some furnace systems include one or more sensors or detectors to monitor the environmental and operating conditions of the furnace system. Information from the sensors and detectors may be relayed to the furnace controller, and the furnace controller may control one or more components based on the information received from the sensors and detectors.

Furnace controllers are often connected to components of the furnace system by wiring harnesses. The use of wiring harnesses facilitates installation of furnace controllers by reducing the number of separate electrical connections needed to connect a furnace controller to a furnace system. However, different furnace systems often have wiring harnesses with different pin configurations. For example, wiring harnesses may have a different geometrical arrangement of pins, a different number of pins, and/or a different electrical arrangement of pins based on the manufacturer of the furnace system. As a result, furnace controllers are generally not compatible with multiple types of furnace systems, such as furnace systems manufactured by different furnace system manufacturers.

Attempts to improve the compatibility of furnace controllers have included providing furnace controllers with a plurality wiring harness adapters or interconnecting devices, which are used to interconnect a furnace controller with the wiring harness of a furnace system. The wiring harness adapters and interconnecting devices often have different pin configurations to enable the furnace controller to be connected to wiring harnesses having different pin configurations.

However, the use of wiring harness adapters and interconnecting devices has several drawbacks. For example, often only one harness adapter or interconnecting device is used to connect a furnace controller to a furnace system. Thus, other harness adapters and interconnecting devices provided with the furnace controller are not used, resulting in excess costs and waste. Additionally, the use of harness adapters and interconnecting devices increases the complexity of installing a furnace controller because it requires additional electrical connections between the furnace system and the furnace controller, and requires proper identification of the harness adapter or interconnecting device needed to connect the furnace controller to a particular furnace system. Accordingly, a need exists for a more satisfactory furnace controller.

This Background section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

SUMMARY

In one aspect, a controller for use in a gas furnace system including a gas valve and an ignition device is provided. The controller includes a circuit board, a control circuit connected to the circuit board, and a plurality of harness connectors mounted to the circuit board. The control circuit is configured to control operation of the gas valve and the ignition device. Each harness connector is configured to mate with a wiring harness to electrically connect the control circuit to at least one component of the furnace system. Each harness connector includes a plurality of pin connectors defining a pin configuration of the corresponding harness connector, and each pin configuration is different than the other pin configurations. At least one pin connector from each harness connector is electrically connected in parallel with one of the pin connectors from each of the other harness connectors.

In another aspect, a furnace system is provided. The furnace system includes a burner, a gas valve for controlling the supply of gas to the burner, an ignition device for igniting gas supplied to the burner assembly, and a controller. The controller includes a circuit board, a control circuit connected to the circuit board, and a plurality of harness connectors mounted to the circuit board. The control circuit is configured to control operation of the gas valve and the ignition device. Each harness connector includes a plurality of pin connectors, and at least one pin connector from each harness connector is electrically connected in parallel with one of the pin connectors from each of the other harness connectors. Only one of the harness connectors is connected to the furnace system by a wiring harness.

In yet another aspect, a method of installing a furnace controller in a furnace system including a gas valve, an ignition device, and a wiring harness is provided. The furnace controller includes a circuit board, a control circuit configured to control operation of the gas valve and the ignition device, and a plurality of harness connectors mounted to the circuit board. Each harness connector includes a plurality of pin connectors, and at least one pin connector from each harness connector is electrically connected in parallel with one of the pin connectors from each of the other harness connectors. The method includes mounting the controller to the furnace system, selecting one of the harness connectors for connection to the wiring harness of the furnace system based on a pin configuration of the wiring harness, and connecting only the selected harness connector to the wiring harness to electrically connect the control circuit to at least one component of the furnace system.

Various refinements exist of the features noted in relation to the above-mentioned aspects. Further features may also be incorporated in the above-mentioned aspects as well. These refinements and additional features may exist individually or in any combination. For instance, various features discussed below in relation to any of the illustrated embodiments may be incorporated into any of the above-described aspects, alone or in any combination.

DETAILED DESCRIPTION

Figure 1:
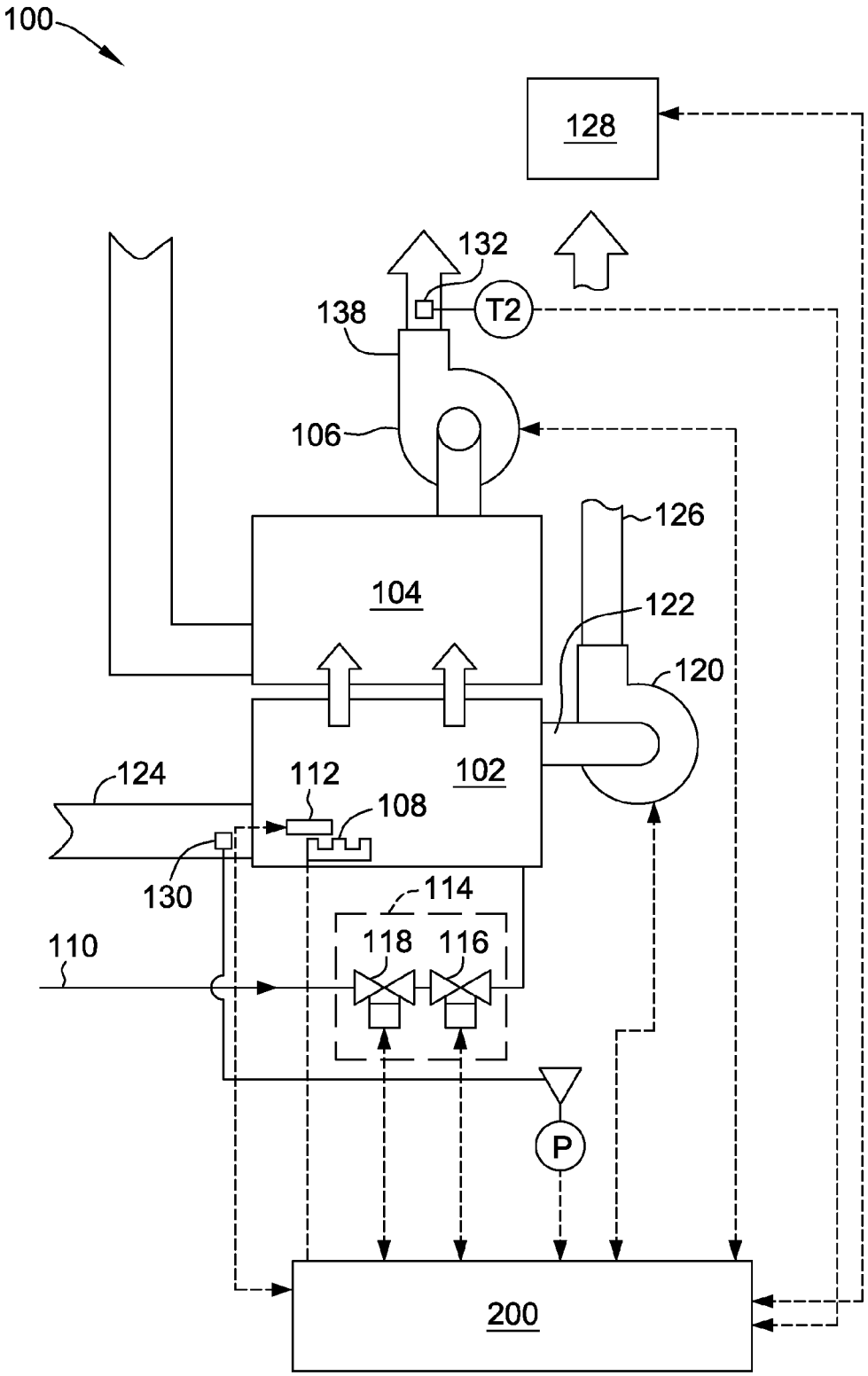
FIG. 1 is a schematic diagram of a gas furnace system including a furnace controller.

Referring to FIG. 1, a gas furnace system of one embodiment for heating a temperature controlled environment is indicated generally at 100. The gas furnace system 100 generally includes a combustion chamber 102 for generating heat from combustible gases, a heat exchanger 104, and an air circulator 106 for circulating fluid (e.g., air) past the heat exchanger 104 to transfer heat generated by the combustion chamber 102 to the circulating fluid.

The combustion chamber 102 includes a burner assembly 108 connected to a gas fuel supply (not shown) via a gas inlet 110, and an ignition device 112, such as a hot surface ignitor, configured to ignite an air/fuel mixture within the combustion chamber 102. The burner assembly 108 includes one or more burners through which fuel gas is fed. The supply of fuel gas to the burner assembly 108 is controlled by a gas valve assembly 114, which, in the illustrated embodiment, includes a main burner valve 116 and a safety valve 118.

An inducer blower 120 is connected to the combustion chamber 102 by a blower inlet 122. The inducer blower 120 is configured to draw fresh (i.e., uncombusted) air into the combustion chamber 102 through an air inlet 124 to mix fuel gas with air to provide a combustible air/fuel mixture. The inducer blower 120 is also configured to force exhaust gases out of the combustion chamber 102 and vent the exhaust gases to atmosphere through an exhaust outlet 126.

The combustion chamber 102 is fluidly connected to the heat exchanger 104. Combusted gases from the combustion chamber 102 are circulated through the heat exchanger 104 while the air circulator 106 forces air from the temperature controlled environment into contact with the heat exchanger 104 to exchange heat between the heat exchanger 104 and the temperature controlled environment. The air circulator 106 subsequently forces the air through an outlet 138 and back into the temperature controlled environment.

The operation of the system 100 is generally controlled by a furnace controller 200 and a thermostat 128 connected to the furnace controller 200. The thermostat 128 is connected to one or more temperature sensors (not shown) for measuring the temperature of the temperature controlled environment. The furnace controller 200 is connected to each of the gas valve assembly 114, the ignition device 112, the inducer blower 120, and the air circulator 106 for controlling operation of the components in response to control signals received from the thermostat 128.

Figure 2:
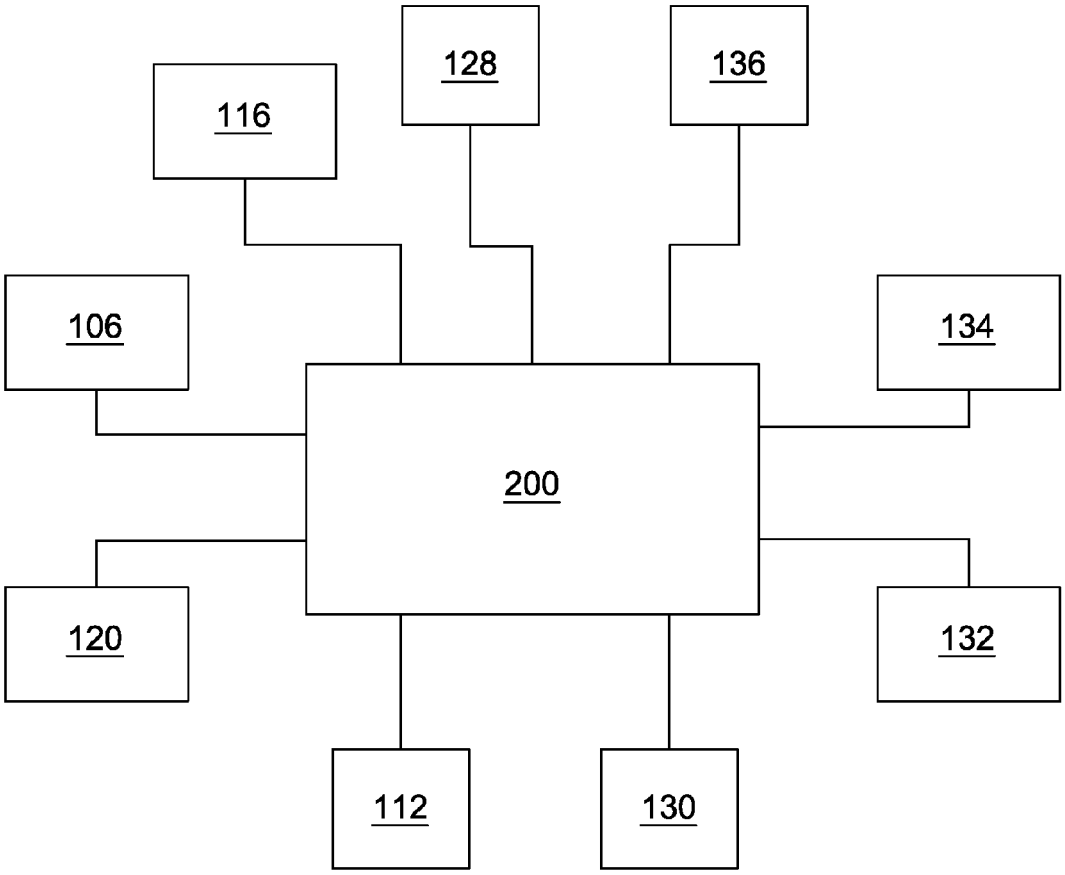
FIG. 2 is a block diagram illustrating the furnace controller of FIG. 1 and the component connections of the gas furnace system of FIG. 1.

With additional reference to FIG. 2, the system 100 includes a plurality of sensors and detectors for monitoring the environmental and operating conditions of the system 100. The illustrated furnace system includes a pressure sensor 130, a temperature sensor 132, a flame rollout detector 134, and a flame sensor 136. The controller 200 is connected to each of the pressure sensor 130, the temperature sensor 132, the flame rollout detector 134, and the flame sensor 136, and is configured to control the furnace system 100 based on signals received from the sensors and detectors.

The pressure sensor 130 is configured to provide a pressure indication to the controller 200 indicative of the pressure within the combustion chamber 102. In the example embodiment, the pressure sensor 130 includes an open/close switch that is opened when a detected pressure is below a threshold pressure limit and closed when a detected pressure is above the threshold pressure limit. In other suitable embodiments, the pressure sensor 130 includes an analog and/or digital sensor configured to output an analog and/or digital signal indicative of an actual or relative pressure to the controller 200. In the illustrated embodiment, the pressure sensor 130 is positioned proximate the air inlet 124, and is configured to detect the pressure of fresh air being supplied to the combustion chamber 102. In other suitable embodiments, the pressure sensor 130 may be positioned at any suitable location within the furnace system 100 that allows the furnace system to function as described herein including, for example and without limitation, within the combustion chamber 102 and within the blower inlet 122.

The temperature sensor 132 is configured to provide a temperature indication to the controller 200 indicative of a temperature T2 within the furnace system 100. In the example embodiment, the temperature sensor 132 includes an open/close switch that is opened when a detected temperature is above a threshold temperature limit and closed when a detected temperature is below the threshold pressure limit. In other suitable embodiments, the temperature sensor 132 includes an analog and/or digital sensor configured to output an analog and/or digital signal indicative of an actual or relative temperature to the controller 200. In the illustrated embodiment, the temperature sensor 132 is positioned proximate the heat exchanger 104, and is configured to detect a high temperature condition within the heat exchanger 104. That is, the temperature sensor 132 is configured to communicate with controller 200 to indicate the presence of a high temperature condition (e.g., a detected temperature above a threshold temperature limit) within the heat exchanger 104.

The flame rollout detector 134 is configured to detect a flame rollout condition within the furnace system 100, and communicate with the controller 200 to indicate that a flame rollout condition has been detected. The term "flame rollout condition" refers to a condition in which the combustion of the air/fuel mixture occurs outside of the normal combustion area within the combustion chamber 102. For example, if the exhaust outlet 126 is impeded during operation, flames that are normally confined to an area immediately adjacent the burner assembly 108 may spread to other areas of the furnace system 100, such as outside the combustion chamber 102, creating a risk of damaging components of the furnace system 100. Flame rollout detector 134 is configured to detect a flame rollout condition to prevent abnormal operation of furnace system 100 and potential damage to components of the furnace system 100. The flame rollout detector 134 may include any suitable detectors and/or sensors that enable the flame rollout detector 134 to function as described herein including, for example and without limitation, temperature sensors, pressure sensors, and optical detectors. In the example embodiment, the flame rollout detector 134 includes an open/close switch that is opened when a flame rollout condition is detected, and closed when the flame rollout condition is no longer detected. In other suitable embodiments, the open/close switch may only be closed following the detection of a flame rollout condition with human intervention (e.g., by resetting the controller 200).

The flame sensor 136 is configured to detect the presence of a flame at the burner assembly 108, and communicate with the controller 200 to indicate the presence or absence of a flame. The flame sensor 136 may include any suitable sensor and/or detector for detecting the presence of a flame including, for example and without limitation, thermo-electric devices (e.g., thermopiles), and optical flame detectors.

Components of the furnace system 100, such as the main burner valve 116, the ignition device 112, the inducer blower 120, the pressure sensor 130, the temperature sensor 132, the flame rollout detector 134, and the flame sensor 136, may be electrically connected to the controller 200 by one or more wiring harnesses. In one suitable embodiment, for example, the main burner valve 116, the pressure sensor 130, the temperature sensor 132, the flame rollout detector 134, and the flame sensor 136 are each electrically connected to the controller 200 by a primary or main wiring harness, and the ignition device 112 and the inducer blower 120 are each electrically connected to the controller 200 by a secondary wiring harness. A wiring harness is an assembly of cables or wires bound or secured together by suitable means including, for example and without limitation, straps, cable ties, cable lacing, sleeves, electrical tape, conduit, and combinations thereof. The wiring harnesses used to connect components of the furnace system 100 to the controller 200 may include a harness connector adapted to mate with a complementary harness connector mounted on the controller 200, described in more detail below. In one suitable embodiment, for example, a wiring harness of the furnace system 100 includes a male harness connector adapted to mate with a female harness connector mounted on the controller 200.

In operation, the thermostat 128 transmits a call for heat to the controller 200 (e.g., in the form of an electrical signal) when a detected temperature within the temperature controlled environment falls below a pre-determined temperature limit. Upon receiving a call for heat, the controller 200 checks the environmental and operating conditions of the furnace system 100 using one or more of the pressure sensor 130, the temperature sensor 132, the flame rollout detector 134, and the flame sensor 136 to ensure the temperature, pressure, and/or other conditions of the furnace system 100 are within predetermined limits. In the example embodiment, the controller 200 outputs a signal to each of the temperature sensor 132 and the flame rollout detector 134 to confirm that the open/close switch of each of the sensors is in the closed position.

Once the environmental and/or operational conditions check is completed, the controller 200 transmits a signal to the inducer blower 120 to energize the inducer blower 120. The controller 200 may check the pressure within the furnace system 100 using the pressure sensor 130 to ensure an adequate supply of fresh (i.e., uncombusted) air is being supplied into the combustion chamber 102. In the example embodiment, the controller 200 outputs a signal to the pressure sensor 130 to confirm that the open/close switch of the pressure sensor 130 is in the closed position.

The controller 200 then outputs a signal to the main burner valve 116 to open the main burner valve 116 and enable the supply of fuel gas to the burner assembly 108. Before, during, or after opening the main burner valve 116, the controller 200 outputs a signal to the ignition device 112 to energize the ignition device 112 and ignite the air/fuel mixture within the combustion chamber 102. Where the ignitor is a hot surface ignitor, such as in the example embodiment, the controller 200 may energize the ignition device 112 prior to energizing the main burner valve 116 to allow the ignition device 112 sufficient time to heat up to a temperature sufficient to initiate combustion.

The controller 200 may then check whether flame initiation was successful via the flame sensor 136. For example, the flame sensor 136 may output a signal to the controller 200 indicating the presence of a flame in the combustion chamber 102. If no flame is detected by flame sensor 136, the controller 200 may de-energize one or more of the main burner valve 116, the ignition device 112, and the inducer blower 120, and reattempt to initiate combustion within the combustion chamber 102. If the flame sensor 136 detects the presence of a flame, the controller 200 energizes the air circulator 106 to circulate air across the heat exchanger 104 and into the temperature controlled environment via outlet 138.

When the call for heat has been satisfied (i.e., when the detected temperature in the temperature controlled environment is equal to or greater than a pre-determined temperature limit), the thermostat 128 outputs a signal to the controller 200 to indicate the call for heat has been satisfied. The controller 200 then de-energizes the main burner valve 116, the inducer blower 120, the ignition device 112, and the air circulator 106. The controller 200 may maintain the inducer blower 120 and/or the air circulator 106 in an energized state for a preset delay period after receiving the signal to terminate the heat cycle.

Figure 3:
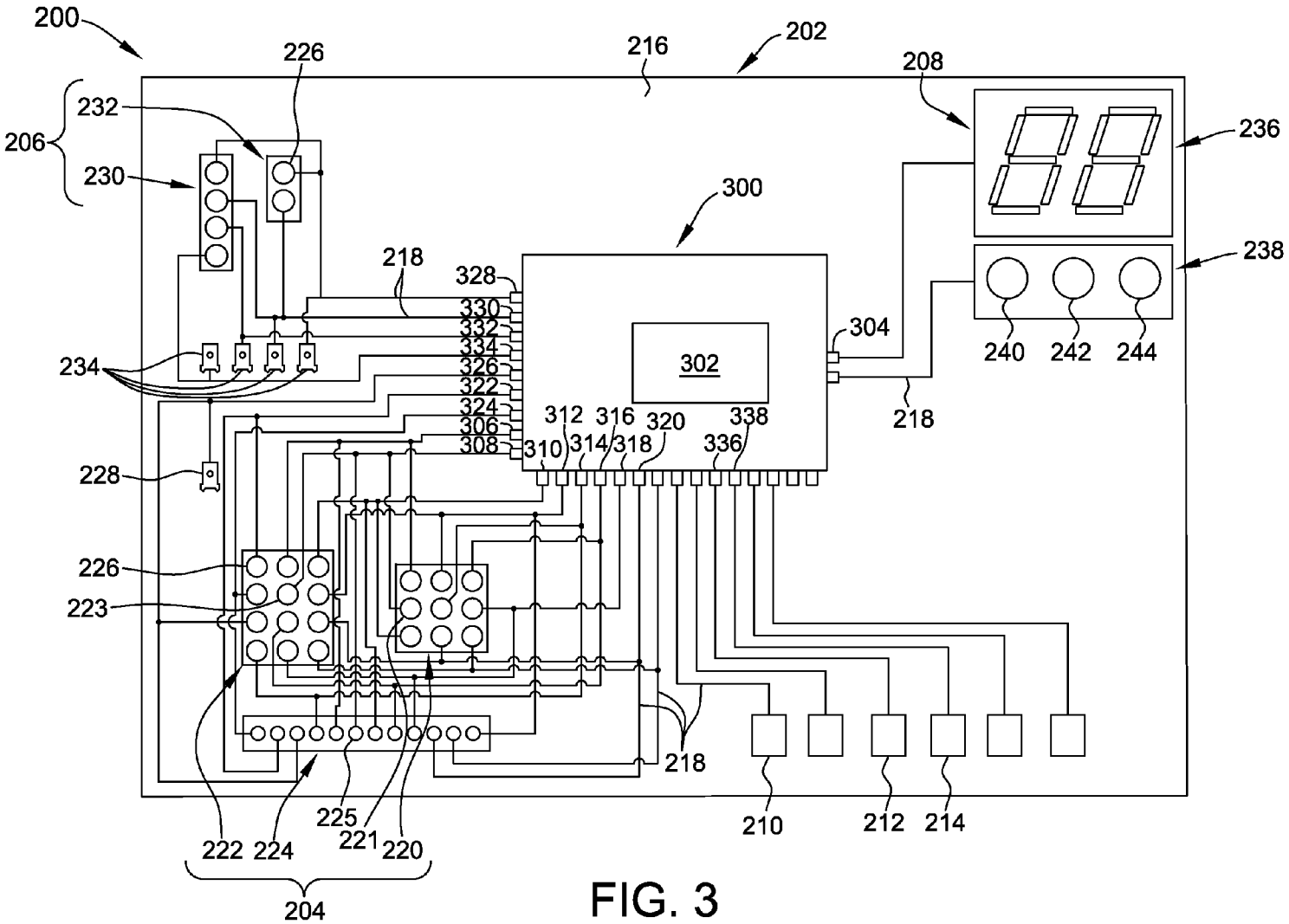
FIG. 3 is a schematic diagram of the furnace controller of FIG. 1 including a computing device and a user interface.

With additional reference to FIG. 3, the controller 200 includes a printed circuit board 202, a plurality of main harness connectors 204, a plurality of secondary harness connectors 206, a user interface 208, and a control circuit 300. The illustrated controller 200 also includes a plurality of input and output connectors, including a power supply input connector 210, a circulator output connector 212, and a circulator return connector 214. The controller 200 may include additional input or output connectors configured to be connected to other components of the furnace system 100 (e.g., the thermostat) for outputting and/or receiving signals from other components of the furnace system 100. The controller 200 may also include a mounting tray (not shown) fabricated from plastic and a plurality of breakaway mounting tabs (not shown) to facilitate positioning and mounting the controller 200 within the furnace system 100.

The printed circuit board 202 includes a dielectric substrate 216 and a plurality of conductive interconnects 218 providing a network of electrical connections between the components coupled to the printed circuit board 202.

The control circuit 300 is configured to control operation of the components of the furnace system 100 by receiving and processing signals from components of the furnace system 100, and by outputting signals to the components of the furnace system 100 based on the received signals. The control circuit 300 may also be configured to control the supply of power to various components of the furnace system 100, for example, by activating switches to open or close a power circuit or by outputting control signals to components of the furnace system 100 to energize such components.

In the illustrated embodiment, the control circuit 300 includes a computing device 302 and a plurality of I/O pins 304 configured to provide electrical communication between the computing device 302 and components of the furnace system 100. The control circuit 300 may also include one or more signal processing circuits (e.g., filter circuits) electrically connected between one of the I/O pins 304 and the computing device 302.

Each I/O pin 304 is adapted for communication with a corresponding target component of the furnace system 100. That is, the computing device 302 is configured (e.g., programmed) to receive and process signals from specific target components of the furnace system 100 at specific I/O pins, and to output signals to specific target components of the furnace system 100 from specific I/O pins. For example, the computing device 302 may be configured to output an energizing signal to the main burner valve 116 (i.e., a first target component) from a first I/O pin based on an input signal received at a second I/O pin from the temperature sensor 132 (i.e., a second target component). Target components may include, for example and without limitation, the pressure sensor 130, the temperature sensor 132, the main burner valve 116, the flame rollout detector 134, the ignition device 112, the inducer blower 120, the air circulator 106, and the thermostat 128 (FIGS. 1 and 2). Target components may also include components of the controller 200 including, for example and without limitation, power switches.

In the illustrated embodiment, the plurality of I/O pins 304 includes a pressure sensor output pin 306, a pressure sensor input pin 308, a temperature sensor output pin 310, a temperature sensor input pin 312, a power input pin 314, a neutral or ground pin 316, a burner valve output pin 318, a burner valve return or common pin 320, a flame rollout detector output pin 322, a flame rollout detector input pin 324, a flame sensor I/O pin 326, an ignition device output pin 328, an ignition device return or common pin 330, an inducer blower output pin 332, an inducer blower return or common pin 334, an air circulator output pin 336, and an air circulator return or common pin 338. The plurality of I/O pins 304 may also include one or more thermostat I/O pins configured for electrical communication with the thermostat 128.

The power input pin 314 and the neutral pin 316 are adapted for connection to a positive or high terminal and a negative or common terminal, respectively, of a power supply (e.g., 24 VAC) to power the controller 200.

The control circuit 300 is configured to output a signal to the temperature sensor 132 via the temperature sensor output pin 310, and receive a signal from the temperature sensor 132 via the temperature sensor input pin 312 to ensure the temperature of the furnace system 100 is within predetermined limits. In the example embodiment, the control circuit 300 outputs a signal to the temperature sensor 132 via the temperature sensor output pin 310 to confirm that the open/close switch of the temperature sensor 132 is closed.

The control circuit 300 is also configured to output a signal to the flame rollout detector 134 via the flame rollout detector output pin 322, and receive a signal from the flame rollout detector 134 at the flame rollout detector input pin 324 to ensure a flame rollout condition is not present within the furnace system 100. In the example embodiment, the control circuit 300 outputs a signal to the flame rollout detector 134 via the flame rollout detector output pin 322 to confirm that the open/close switch of the flame rollout detector 134 is closed.

The control circuit 300 is configured to energize the inducer blower 120 via the inducer blower output pin 332 and the inducer blower common pin 334. In one suitable embodiment, for example, the control circuit 300 closes a switch between the inducer blower output pin 332 and the inducer blower common pin 334 to form a closed power circuit to provide power to the inducer blower 120.

The control circuit 300 is configured to output a signal to the pressure sensor 130 via the pressure sensor output pin 306, and receive a signal from the pressure sensor 130 via the pressure sensor input pin 308 to ensure that an adequate supply of fresh (i.e., uncombusted) air is being supplied to the furnace system 100 by the inducer blower 120. In the example embodiment, the control circuit 300 outputs a signal to the pressure sensor 130 via the pressure sensor output pin 306 to confirm that the open/close switch of the pressure sensor 130 is closed.

The control circuit 300 is configured to energize the main burner valve 116 via the burner valve output pin 318 and the burner valve return pin 320. In one embodiment, for example, the control circuit 300 closes a switch between the burner valve output pin 318 and the burner valve return pin 320 to form a closed power circuit to energize the main burner valve 116 and maintain the main burner valve 116 in an open position.

The control circuit 300 is configured to energize the ignition device 112 via the ignition device output pin 328 and the ignition device return pin 330. In one embodiment, for example, the control circuit 300 closes a switch between the ignition device output pin 328 and the ignition device return pin 330 to form a closed power circuit to energize the ignition device 112 and ignite the air/fuel mixture within the combustion chamber 102. As described in more detail herein, the output voltage supplied to the ignition device 112 via the ignition device output pin 328 and the ignition device return pin 330 may be selectively configurable between a plurality of ignition device output voltages.

The control circuit 300 is configured to receive a signal from the flame sensor 136 via the flame sensor I/O pin 326 to determine whether a flame is present in the furnace system 100.

The control circuit 300 is configured to energize the air circulator 106 via the air circulator output pin 336 and the air circulator return pin 338. In one suitable embodiment, for example, the air circulator 106 is connected to a power supply, and the control circuit 300 is configured to output a circulator control voltage to the air circulator 106 to activate the power supply and energize the air circulator 106.

The main harness connectors 204 are configured to provide an electrical connection between the control circuit 300 and components of the furnace system 100 to enable the control circuit 300 to function as described herein. More specifically, each of the main harness connectors 204 is electrically connected to the control circuit 300 via the conductive interconnects 218. Each of the main harness connectors 204 is configured to mate with a wiring harness of a furnace system to provide an electrical connection between the control circuit 300 and components of the furnace system. In the illustrated embodiment, the plurality of main harness connectors 204 includes a first main harness connector 220, a second main harness connector 222, and a third main harness connector 224. Although the illustrated controller 200 includes three main harness connectors 204, the controller 200 may include more than or less than three main harness connectors 204.

Each of the main harness connectors 204 includes a plurality of pin connectors 226. Each pin connector 226 is adapted to receive one of a plurality pins from a corresponding wiring harness to provide an electrical connection between the control circuit 300 and one of the components of the furnace system 100. In the illustrated embodiment, each pin connector 226 has a generally circular shape, although it is understood that the pin connectors may have any suitable shape that enables the controller 200 to function as described herein.

Each of the plurality of pin connectors 226 defines a pin configuration of the corresponding main harness connector 204. The term "pin configuration" as used with respect to the main harness connectors 204 refers to the number, geometrical arrangement, and electrical arrangement of the pin connectors 226. As seen in FIG. 3, each of the main harness connectors 204 has a different pin configuration than the other main harness connectors 204. More specifically, the first main harness connector 220 includes nine pin connectors 226 generally arranged in square configuration, the second main harness connector 222 includes twelve pin connectors 226 generally arranged in a rectangular configuration, and the third main harness connector 224 includes twelve pin connectors 226 arranged in a linear or "in-line" configuration.

Each of the main harness connectors 204 is configured to mate with a wiring harness having a pin configuration complementary to the pin configuration of the respective main harness connector 204. Thus, in the illustrated embodiment, each main harness connector 204 is configured to mate with a different type of wiring harness (i.e., wiring harnesses having different pin configurations). More specifically, each main harness connector 204 has a pin configuration that corresponds to one of a plurality of industry standard wiring harnesses such that the controller 200 can be installed in (i.e., electrically connected to) furnace systems manufactured by different furnace system manufactures using one of the main harness connectors 204 without an interface or adapter harness.

Each pin connector 226 is electrically connected to the control circuit 300 via one of the interconnects 218. As shown in FIG. 3, at least one pin connector 226 from each main harness connector 204 is electrically connected in parallel with one of the pin connectors 226 from each of the other main harness connectors 204. In the illustrated embodiment, each pin connector 226 from the first main harness connector 220 is electrically connected in parallel with one pin connector 226 from each of the second main harness connector 222 and the third main harness connector 224. Further, each pin connector 226 from the second main harness connector 222 is connected in parallel with one pin connector 226 from the third main harness connector 224.

Pin connectors 226 from different main harness connectors 204 that are connected in parallel with one another are also connected to a common I/O pin 304 on the control circuit 300. For example, in the illustrated embodiment, one pin connector 226 from each of the main harness connectors 204 is connected to the temperature sensor output pin 310 and is connected in parallel with the other pin connectors 226 connected to the temperature sensor output pin 310.

Each pin connector 226 is adapted for electrical connection to a target component of the furnace system 100 based upon the I/O pin 304 to which the pin connector 226 is connected. Further, each pin connector 226 is adapted to output and/or or receive a signal from a target component based upon the I/O pin 304 to which the pin connector 226 is connected. For example, each pin connector 226 connected to the temperature sensor output pin 310 is adapted for electrical connection to the temperature sensor 132, and is adapted to output a signal to the temperature sensor 132. Each pin connector 226 connected to the temperature sensor input pin 312 is adapted for electrical connection to the temperature sensor 132, and is adapted to receive a signal from the temperature sensor 132.

In the illustrated embodiment, each of the main harness connectors 204 is configured to provide an electrical connection between the control circuit 300 and the pressure sensor 130, the temperature sensor 132, and the main burner valve 116. Further, in the illustrated embodiment, the second main harness connector 222 and the third main harness connector 224 are configured to provide an electrical connection between the control circuit 300 and the flame rollout detector 134 and the flame sensor 136.

One or more of the pin connectors 226 from each of the main harness connectors 204 may be "remapped" by modifying the I/O pin configuration of the control circuit 300. More specifically, the control circuit 300 is selectively configurable between a plurality of I/O pin configurations in which the control circuit 300 processes signals differently or outputs signals differently from the same I/O pin in different I/O pin configurations. For example, in a first I/O pin configuration, such as the I/O pin configuration illustrated in FIG. 3, the control circuit 300 is configured to receive an input signal from the pressure sensor 130 at the I/O pin designated 308. The control circuit 300 (in particular, the computing device 302) may be configured to process this signal and output one or more signals to one or more other components of the furnace system 100 based on the signal received at the I/O pin 308. Thus, in the first I/O pin configuration, each pin connector 226 connected to the I/O pin 308 is adapted for connection to the pressure sensor 130, and is adapted to receive an input signal from the pressure sensor 130. In the illustrated embodiment, one pin connector from each of the main harness connectors 204, indicated at 221, 223, and 225, is connected to I/O pin 308. Thus, in the first I/O pin configuration, each of the pin connectors 221, 223, and 225 is adapted for connection to the pressure sensor 130, and is adapted to receive an input signal from the pressure sensor 130.

In a second I/O pin configuration, each of the pin connectors 221, 223, and 225 connected to I/O pin 308 may be adapted for connection to a different component of the furnace system 100, and/or may be adapted to output or receive a signal from the input signal from the pressure sensor 130. For example, in a second I/O pin configuration, the control circuit 300 is configured to receive an input signal from the temperature sensor 132 at the I/O pin designated 308, and is configured to process the input signal and output one or more signals to one or more other components of the furnace system 100 based on the input signal received at the I/O pin 308. Additionally, in the second I/O pin configuration, the control circuit 300 is configured to receive an input signal from the pressure sensor 130 at the I/O pin designated 312, and is configured to process the input signal and output one or more signals to one or more other components of the furnace system 100 based on the input signal received at the I/O pin 312. Thus, in the second I/O pin configuration, each of the pin connectors 221, 223, and 225 is adapted for connection to the temperature sensor 132, and is adapted to receive an input signal from the temperature sensor 132. Further, in the second I/O pin configuration, each pin connector 226 connected to the I/O pin designated 312 is adapted for connection to the pressure sensor 130, and is adapted to receive in input signal from the pressure sensor 130. By providing main harness connectors 204 with different pin configurations on a single controller, and enabling the pin connectors 226 of the main harness connectors 204 to be remapped, the controller 200 can be electrically connected to furnace systems having different types of main wiring harnesses without using an interface or adapter harness connector. The controller 200 of the present disclosure thereby provides improved compatibility with furnace systems having different types of wiring harnesses, and facilitates reducing the part-count and cost of furnace controllers.

The illustrated controller 200 also includes a flame sensor input connector 228 separate from each of the main harness connectors 204. The controller 200 is therefore compatible with a furnace system having a flame sensor connecting cable separate from the main wiring harness. The flame sensor input connector 228 is connected to the flame sensor I/O pin 326, and is connected in parallel with each of the pin connectors 226 from the main harness connectors 204 that are connected to the flame sensor I/O pin 326.

The secondary harness connectors 206 are configured to provide an electrical connection between the control circuit 300 and components of the furnace system 100 that are not connected to the control circuit 300 by one of the main harness connectors 204. Each of the secondary harness connectors 206 is electrically connected to the control circuit 300 via the conductive interconnects 218. Each secondary harness connector 206 is configured to mate with a wiring harness of a furnace system to provide an electrical connection between the control circuit 300 and components of the furnace system. In particular, each secondary harness connector 206 is configured to mate with a secondary wiring harness of a furnace system to provide an electrical connection between the control circuit 300 and at least one of an ignition device and an induced blower of the furnace system. In the illustrated embodiment, the plurality of secondary harness connectors 206 includes a first secondary harness connector 230 and a second secondary harness connector 232. Although the illustrated controller 200 includes two secondary harness connectors 206, the controller 200 may include more than or less than two secondary harness connectors 206.

Each of the secondary harness connectors 206 includes a plurality of the pin connectors 226. Each pin connector 226 of the secondary harness connectors 206 is adapted to receive one of a plurality pins from a corresponding wiring harness to provide an electrical connection between the control circuit 300 and one of the components of the furnace system 100. In the illustrated embodiment, each pin connector 226 has a generally circular shape, although it is understood that the pin connectors may have any suitable shape that enables the controller 200 to function as described herein.

Each of the plurality of pin connectors 226 of the secondary harness connectors 206 defines a pin configuration of the corresponding secondary harness connector 206. The term "pin configuration" as used with respect to the secondary harness connectors 206 refers to the number, geometrical arrangement, and electrical arrangement of the pin connectors 226. As seen in FIG. 3, each of the secondary harness connectors 206 has a different pin configuration than the other secondary harness connector 206. More specifically, the first secondary harness connector 230 includes four pin connectors 226 arranged in a linear or "in-line" configuration, and the second secondary harness connector 232 includes two pin connectors 226 arranged in a linear or "in-line" configuration.

Each secondary harness connector 206 is configured to mate with a wiring harness having a pin configuration complementary to the pin configuration of the respective secondary harness connector 206. Thus, in the illustrated embodiment, each secondary harness connector 206 is configured to mate with a different type of wiring harness (i.e., wiring harnesses having different pin configurations). More specifically, each secondary harness connector 206 has a pin configuration that corresponds to one of a plurality of industry standard wiring harnesses such that the controller 200 can be installed in (i.e., electrically connected to) furnace systems manufactured by different furnace system manufactures using one of the secondary harness connectors 206 without an interface or adapter harness.

Each pin connector 226 of the secondary harness connectors 206 is electrically connected to the control circuit 300 via one of the interconnects 218. As shown in FIG. 3, at least one pin connector 226 from each secondary harness connector 206 is electrically connected in parallel with one of the pin connectors 226 from each of the other secondary harness connectors 206. In the illustrated embodiment, each pin connector 226 from the second secondary harness connector 232 is electrically connected in parallel with one pin connector 226 from the first secondary harness connector 230.

Similar to the main harness connectors 204, pin connectors 226 from different secondary harness connectors 206 that are connected in parallel with one another are also connected to a common I/O pin 304 on the control circuit 300. Additionally, one or more of the pin connectors 226 from each of the secondary harness connectors 206 may be remapped by modifying the I/O pin configuration of the control circuit 300 in the same manner described above.

The illustrated controller 200 also includes a plurality of separate secondary component connectors 234, each of which is connected in parallel with one of the pin connectors 226 from at least one of the secondary harness connectors 206. The secondary component connectors 234 are configured to provide an electrical connection between the control circuit 300 and at least one of an ignition device and an inducer blower via non-harnessed cables or wires. In the illustrated embodiment, the secondary component connectors 234 are spade-type connectors, although the secondary component connectors 234 may include any suitable connector that enables the controller 200 to function as described herein including, for example and without limitation, screw-type connectors.

The circulator output connector 212 and the circulator return connector 214 are configured to provide an electrical connection between the air circulator 106 and the control circuit 300. The circulator output connector 212 and the circulator return connector 214 are each connected to the control circuit 300 via conductive interconnects 218. The circulator output connector 212 and the circulator return connector 214 may include any suitable connector that enables the controller 200 to function as described herein including, for example and without limitation, spade-type connectors and screw-type connectors.

The controller 200 is configured to energize the air circulator 106 by supplying a control voltage to the air circulator 106 via the circulator output connector 212 and the circulator return connector 214. As described in more detail herein, the controller 200 may be configured to output one of a plurality of circulator control voltages based on a user selection. The controller 200 may also be configured to output a control voltage to the air circulator 106 based upon an operating mode of the furnace system 100. For example, in one embodiment, the controller 200 may be configured to output a first control voltage that corresponds to a first, low fan speed, and a second control voltage that corresponds to a second, higher fan speed.

The user interface 208 is connected to the circuit board 202, and is electrically connected to the computing device 302 via interconnects 218. In the illustrated embodiment, the user interface 208 is electrically connected to the computing device 302 through the control circuit 300. The user interface 208 includes a display device 236 and an input interface 238. The user interface 208 is configured to present user configurable settings of the controller 200 to a user with the display device 236, and receive and store user selections associated with the user configurable settings with the input interface 238.

In the illustrated embodiment, the display device 236 includes a seven-segment liquid crystal display (LCD), although the display device 236 may include any suitable display device that enables the controller 200 to function as described herein, such as, for example, a cathode ray tube (CRT), a liquid crystal display (LCD), an organic LED (OLED) display, an LED matrix display, and/or an "electronic ink" display. Further, the display device 236 may include more than one display device. In the illustrated embodiment, the display device is configured to display user-configurable settings and a plurality of options corresponding to each user-configurable setting. In another suitable embodiment, the display device 236 includes a plurality individual light indicators (e.g., LEDs) each corresponding to one of the user-configurable settings and/or the plurality of options corresponding to the user-configurable setting.

The input interface 238 is configured to receive input from a user. In the illustrated embodiment, the input interface 238 includes a plurality of push buttons 240, 242, 244 to receive input from a user. The push buttons 240 and 244 allow a user to cycle through user-configurable settings and user-selectable options corresponding to the user-configurable setting. The push button 242 allows a user to select a user-configurable setting and a user-selectable option corresponding to a user-configurable setting. In other embodiments, the input interface 238 may include any suitable input device that enables the controller 200 to function as described herein, such as, for example, a keyboard, a pointing device, a mouse, a stylus, a touch sensitive panel (e.g., a touch pad or a touch screen), a gyroscope, an accelerometer, a position detector, and/or an audio user input interface. A single component, such as a touch screen, may function as both the display device 236 and the input interface 238.

Figure 4:
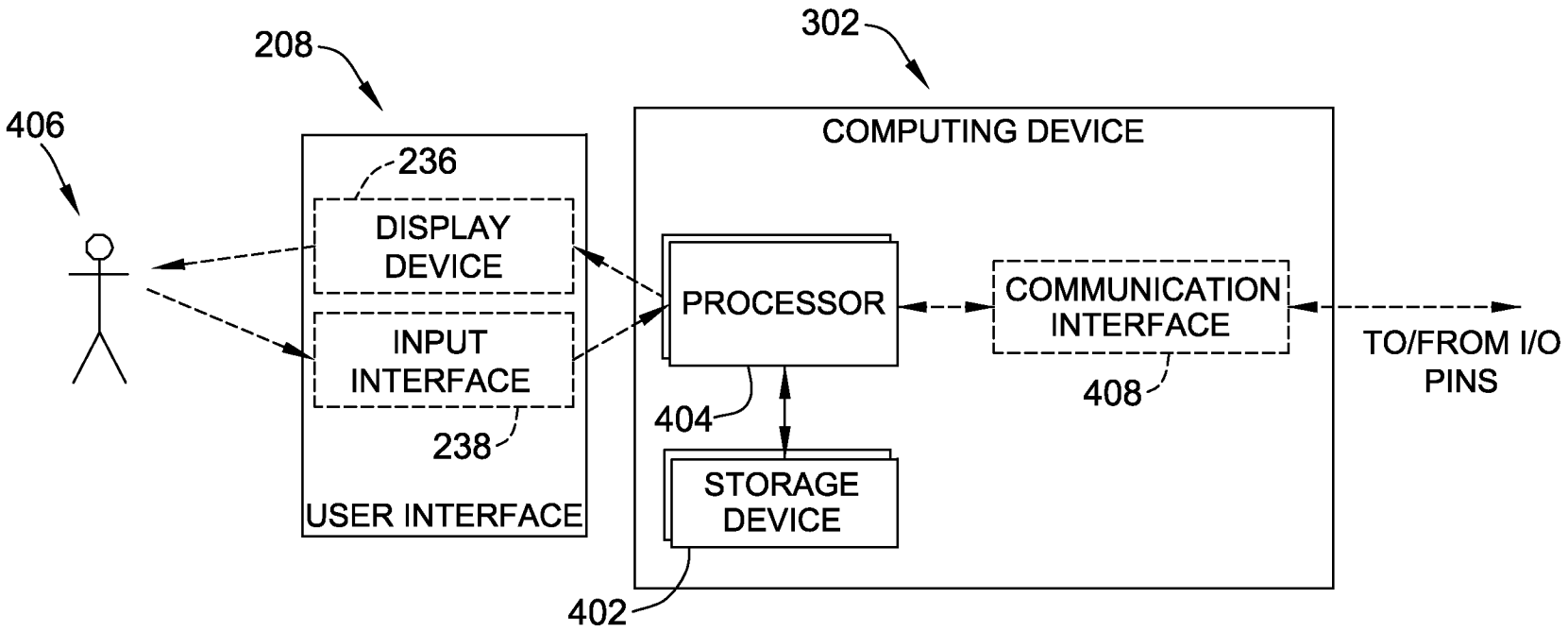
FIG. 4 is a block diagram of the computing device and the user interface of FIG. 3.

FIG. 4 is a block diagram of the computing device 302 and the user interface 208. The computing device 302 includes at least one computer-readable storage device 402 and a processor 404 that is coupled to the storage device 402 for executing instructions. In this embodiment, executable instructions are stored in the storage device 402, and the computing device 302 performs one or more operations described herein by programming the processor 404. For example, the processor 404 may be programmed by encoding an operation as one or more executable instructions and by providing the executable instructions in the storage device 402.

The processor 404 may include one or more processing units (e.g., in a multi-core configuration). Further, the processor 404 may be implemented using one or more heterogeneous processor systems in which a main processor is present with secondary processors on a single chip. As another illustrative example, the processor 404 may be a symmetric multi-processor system containing multiple processors of the same type. Further, the processor 404 may be implemented using any suitable programmable circuit including one or more systems and microcontrollers, microprocessors, programmable logic controllers (PLCs), reduced instruction set circuits (RISC), application specific integrated circuits (ASIC), programmable logic circuits, field programmable gate arrays (FPGA), and any other circuit capable of executing the functions described herein. Further, the processor 404 may include an internal clock to monitor the timing of certain events.

The storage device 402 is one or more devices that enable information such as executable instructions and/or other data to be stored and retrieved. The storage device 402 may include one or more computer readable media, such as, without limitation, dynamic random access memory (DRAM), static random access memory (SRAM), a solid state disk, and/or a hard disk. The storage device 402 may be configured to store, without limitation, application source code, application object code, source code portions of interest, object code portions of interest, configuration data, execution events and/or any other type of data.

As noted above, the user interface 208 includes a display device (broadly, a presentation interface) 236 and an input interface 238. The display device 236 is coupled to the processor 404, and presents information, such as user-configurable settings, to a user 406, such as a technician. The input interface 238 is coupled to the processor 404 and is configured to receive input from the user 406.

The computing device 302 further includes a communication interface 408 coupled to processor 404. The communication interface 408 is coupled to the I/O pins 304, and enables the processor 404 to communicate with one or more components of the furnace system 100.

As noted above, the controller 200 of the present disclosure is configured to receive and store user selections corresponding to a plurality of user-configurable settings. User-configurable settings include, but are not limited to, an ignition device voltage, a circulator voltage, and an I/O pin configuration.

The ignition device voltage setting enables a user to select between one of a plurality of ignition device voltages to be supplied to the ignition device 112 by the controller 200. The controller 200 is configured to output one of the plurality of ignition device voltages to the ignition device 112 based on a user selected ignition device voltage. In other words, the controller 200 is selectively configurable between a plurality of ignition device voltages. In one suitable embodiment, the plurality of ignition device voltages includes a first ignition device voltage and a second ignition device voltage that is less than the first ignition device voltage. In one particular embodiment, the first ignition device voltage is 80 VAC and the second ignition device voltage is 120 VAC. That is, when the first ignition device voltage is selected, the controller 200 is configured to output 80 VAC to the ignition device 112, and when the second ignition device voltage is selected, the controller 200 is configured to output 120 VAC to the ignition device 112.

The circulator voltage setting enables a user to select between one of a plurality of circulator control voltages to be supplied to the air circulator 106 by the controller 200. The controller 200 is configured to output one of the plurality of circulator control voltages to the air circulator 106 based on a user selected circulator voltage. In other words, the controller 200 is selectively configurable between a plurality of circulator control voltages. In one suitable embodiment, the plurality of circulator control voltages includes a first circulator control voltage and a second circulator control voltage that is greater than the first circulator control voltage. In one particular embodiment, the first circulator control voltage corresponds to a voltage requirement of permanent split capacitor (PSC) type air circulators, and the second circulator control voltage corresponds to a voltage requirement of electrically commutated motor (EMC) type air circulators. In such embodiments, the first circulator control voltage may be 120 VAC, and the second circulator control voltage may be at least one of 24 VAC, 24 VDC, and a modulated 24 VDC signal (such as a pulse-width modulated signal). That is, when the first circulator control voltage is selected, the controller 200 is configured to output 120 VAC to the air circulator 106, and when the second circulator control voltage is selected, the controller 200 is configured to output at least one of 24 VAC, 24 VDC, and a modulated 24 VDC signal to the air circulator 106.

The I/O pin configuration setting enables a user to select one of a plurality of I/O pin configurations of the control circuit 300, where the control circuit 300 processes signals differently or outputs signals differently from the same I/O pin in different I/O pin configurations. Because each of the pin connectors 226 is connected to one of the I/O pins 304, the I/O pin configuration setting enables a user to remap the pin connectors 226 of one or more of the main harness connectors 204 and the secondary harness connectors 206. Thus, the I/O pin configuration setting may also be referred to as a harness connector pin configuration setting because it enables a user to select one of a plurality of harness connector pin configurations.

In some embodiments, each of the I/O pin configurations (and, more particularly, the corresponding pin configurations of the main harness connectors 204 and secondary harness connectors 206) may correspond to one of a plurality of furnace system manufacturers' standard wiring harness configurations. Examples of furnace system manufacturers to which the I/O pin configurations may correspond include, but are not limited to, Carrier Corporation of Farmington, Conn., Goodman Manufacturing Company, L.P., of Houston, Tex., Lennox International Inc. of Richardson, Tex., Trane, a subsidiary of Ingersoll Rand of Dublin, Ireland, Rheem Manufacturing Company of Atlanta, Ga., York, a subsidiary of Johnson Controls, Inc. of Milwaukee, Wis., and Nordyne LLC of O'Fallon, Mo.

The controller 200, and, more specifically, the user interface 208, is configured to display the user configurable settings, and receive a user selection of one of the user configurable settings. For each user-configurable setting, the controller 200, and, more specifically, the user interface 208, is configured to display a plurality of user-selectable options corresponding to one of the user-configurable settings, and receive a user-selection of one of the plurality of options.

As noted above, the controller 200 of the present disclosure can be installed in furnace systems manufactured by different furnace system manufactures without using interface or adapter harnesses (broadly, interconnecting harnesses). In particular, the controller 200 includes multiple main harness connectors 204 and multiple secondary harness connectors 206 mounted on a single board, where each harness connector has a different pin configuration. Further, the controller 200 enables one or more of the pin connectors 226 of the main harness connectors 204 and the secondary harness connectors 206 to be remapped so that the pin configurations of the harness connectors can be modified to match the wiring harness of a particular furnace system. As a result, a user, such as a technician, may install the controller 200 in a variety of different furnace systems manufactured by different furnace system manufacturers without using an adapter or interface harness.

To install the controller 200 in a furnace system, such as the furnace system 100 shown in FIG. 1, one of the main harness connectors 204 is connected to the main wiring harness of the furnace system to provide an electrical connection between the control circuit 300 and components of the furnace system. Only one of the main harness connectors 204 is configured to be electrically connected to a furnace system at a time. Thus, only one of the main harness connectors 204 is connected to the main wiring harness of the furnace system. The main harness connector 204 may be directly connected to the main wiring harness of the furnace system (i.e., without any interconnecting harnesses or devices). In the illustrated embodiment, each of the main harness connectors 204 provides an electrical connection between the control circuit 300 and the pressure sensor 130, the temperature sensor 132, and the main burner valve 116. Further, in the illustrated embodiment, the second main harness connector 222 and the third main harness connector 224 are configured to provide an electrical connection between the control circuit 300 and the flame rollout detector 134 and the flame sensor 136.

One of the secondary harness connectors 206 is connected to a secondary wiring harness of the furnace system to provide an electrical connection between the control circuit 300 and other components of the furnace system that are not electrically connected to the control circuit via one of the main harness connectors 204. In particular, each secondary harness connector 206 is configured to provide an electrical connection between the control circuit 300 and at least one of an ignition device and an inducer blower of the furnace system. Only one of the secondary harness connectors 206 is configured to be electrically connected to a furnace system at a time. Thus, only one of the secondary harness connectors 206 is connected to the secondary wiring harness of the furnace system. The secondary harness connector 206 may be directly connected to the secondary wiring harness of the furnace system (i.e., without any interconnecting harnesses or devices).

The user configurable settings of the controller 200 may be configured using the user interface 208. For example, one of the plurality of I/O pin configurations may be selected using the user interface 208 based upon the configuration of the main wiring harness and/or the secondary wiring harness of the furnace system in which the controller 200 is installed. Further, one of the plurality of ignition device voltages may be selected using the user interface 208 based upon the type of ignition device installed in the furnace system. Similarly, one of the plurality of circulator control voltages may be selected using the user interface 208 based upon the type of circulator installed in the furnace system.

In some embodiments, the controller 200 is mounted to the furnace system 100 to provide a fixed support for the controller 200. The controller 200 may be mounted to the furnace system 100 at any suitable location. In one suitable embodiment, the controller 200 is mounted to the furnace system 100 using suitable fasteners, such as screws or bolts. The controller 200 may be mounted to the furnace system 100 before, during, or after any of the above-described steps.

Embodiments of the methods and systems described herein achieve superior results as compared to prior methods and systems. For example, the furnace controllers described herein facilitate reducing the overall part-count and cost associated with furnace controllers, and provide increased compatibility as compared to known furnace controllers. In particular, the furnace controllers described herein provide multiple main harness connectors and multiple secondary harness connectors on a single control board, and enable pin connectors of the harness connectors to be remapped by modifying the I/O pin configuration of the control circuit. By providing multiple main harness connectors and multiple secondary harness connectors on the controller, and enabling the pin connectors of the harness connectors to be remapped, the furnace controllers of the present disclosure reduce or eliminate the need for interface or adapter harnesses commonly used to connect furnace controllers to furnace systems. As a result, the furnace controllers of the present disclosure have an overall reduced part-count and cost as compared to known furnace controllers, and facilitate installation by reducing the total number of connections needed to be made between the controller and a furnace system. Further, the furnace controllers described herein provide increased compatibility as compared to some known furnace controllers by enabling a user to select from a plurality of output voltages for certain components of furnace systems, such as the ignition device and the circulator.

Example embodiments of gas-powered furnace systems and furnace controllers are described above in detail. The system and controller are not limited to the specific embodiments described herein, but rather, components of the system and controller may be used independently and separately from other components described herein.

When introducing elements of the present disclosure or the embodiment(s) thereof, the articles "a", "an", "the" and "said" are intended to mean that there are one or more of the elements. The terms "comprising," "including," "containing" and "having" are intended to be inclusive and mean that there may be additional elements other than the listed elements. The use of terms indicating a particular orientation (e.g., "top", "bottom", "side", etc.) is for convenience of description and does not require any particular orientation of the item described.

As various changes could be made in the above constructions and methods without departing from the scope of the disclosure, it is intended that all matter contained in the above description and shown in the accompanying drawing(s) shall be interpreted as illustrative and not in a limiting sense.

What is claimed is:

1. A controller for use in a gas furnace system including a gas valve and an ignition device, the controller comprising:

a circuit board;

a control circuit connected to the circuit board and configured to control operation of the gas valve and the ignition device; and a plurality of harness connectors mounted to the circuit board, each harness connector configured to mate with a complementary wiring harness to electrically connect the control circuit to at least one component of the furnace system, each harness connector including a plurality of pin connectors defining a pin configuration of the corresponding harness connector, each pin configuration being different than the other pin configurations, wherein at least one pin connector from each harness connector is electrically connected in parallel with one of the pin connectors from each of the other harness connectors.

2. The furnace controller of claim 1, wherein the control circuit includes a plurality of I/O pins for electrical communication with components of the furnace system, wherein a first pin connector from each harness connector is connected to a first I/O pin of the plurality of I/O pins, each first pin connector connected in parallel with each of the other first pin connectors.

3. The furnace controller of claim 2, wherein the control circuit is configurable between a first I/O pin configuration and a second I/O pin configuration, wherein the first I/O pin is configured to output or receive a first signal in the first I/O pin configuration and a second signal in the second pin configuration that is different than the first signal.

4. The furnace controller of claim 3, wherein each I/O pin configuration corresponds to one of a plurality of furnace system manufactures' default wiring harness configurations.

5. The furnace controller of claim 1, wherein the controller is configured to output one of a first ignition device voltage and a second ignition device voltage to the ignition device based upon a user selected ignition device voltage.

6. The furnace controller of claim 1, wherein the furnace system further includes an air circulator, the controller further configured to output one of a first circulator control voltage and a second circulator control voltage to the air circulator based upon a user selected circulator voltage.

7. The furnace controller of claim 1, wherein each of the harness connectors is a main harness connector, the controller further comprising a plurality of secondary harness connectors, each of the secondary harness connectors configured to mate with a wiring harness to electrically connect the control circuit to at least one of an ignition device and an inducer blower of the furnace system.

8. The furnace controller of claim 1, wherein the furnace system further includes a flame sensor, wherein one of the pin connectors of at least one of the harness connectors is configured to receive an input signal from the flame sensor, the control board further comprising a flame sensor input connector separate from each of the harness connectors, the flame sensor input connector connected in parallel with each of the pin connectors configured to receive an input signal from the flame sensor.

9. A furnace system comprising:

a burner;

a gas valve for controlling the supply of gas to the burner;

an ignition device for igniting gas supplied to the burner; and a controller comprising:

a circuit board;

a control circuit connected to the circuit board and configured to control operation of the gas valve and the ignition device; and a plurality of harness connectors mounted to the circuit board, each harness connector including a plurality of pin connectors, at least one pin connector from each harness connector electrically connected in parallel with one of the pin connectors from each of the other harness connectors, wherein only one of the harness connectors is connected to the furnace system by a wiring harness, the wiring harness being complementary to the one harness connector.

10. The furnace system of claim 9, wherein the control circuit includes a plurality of I/O pins for electrical communication with components of the furnace system, wherein a first pin connector from each harness connector is connected to a first I/O pin of the plurality of I/O pins, each first pin connector connected in parallel with each of the other first pin connectors.

11. The furnace system of claim 10, wherein the control circuit is configurable between a first I/O pin configuration and a second I/O pin configuration, wherein the first I/O pin is configured to output or receive a first signal in the first I/O pin configuration and a second signal in the second pin configuration that is different than the first signal.

12. The furnace system of claim 11, wherein each I/O pin configuration corresponds to one of a plurality of furnace system manufactures' default wiring harness configurations.

13. The furnace system of claim 9, wherein each of the harness connectors has a pin configuration defined by the plurality of pin connectors corresponding to the harness connector, wherein each pin configuration is different than the other pin configurations and at least one of the harness connectors has a different number of pin connectors than the other harness connectors.

14. The furnace system of claim 9, wherein the controller is configured to output one of a first ignition device voltage and a second ignition device voltage to the ignition device based upon a user selected ignition device voltage.

15. The furnace system of claim 9, further comprising an air circulator, the controller further configured to output one of a first circulator control voltage and a second circulator control voltage to the air circulator based upon a user selected circulator voltage.

16. The furnace system of claim 9, wherein each of the harness connectors is a main harness connector, the controller further comprising a plurality of secondary harness connectors, wherein only one of the secondary harness connectors is connected to the furnace system by a wiring harness to provide an electrical connection between the control circuit and the ignition device.

17. A method of installing a furnace controller in a furnace system including a gas valve, an ignition device, and a wiring harness, the furnace controller including a circuit board, a control circuit configured to control operation of the gas valve and the ignition device, and a plurality of harness connectors mounted to the circuit board, each harness connector including a plurality of pin connectors, wherein at least one pin connector from each harness connector is electrically connected in parallel with one of the pin connectors from each of the other harness connectors, the method comprising:

mounting the controller to the furnace system;

selecting one of the harness connectors for connection to the wiring harness of the furnace system based on a pin configuration of the wiring harness, the one harness connector having a pin configuration complementary to the pin configuration of the wiring harness; and connecting only the selected harness connector to the wiring harness to electrically connect the control circuit to at least one component of the furnace system.

18. The method of claim 17, wherein connecting only one of the harness connectors includes connecting the one harness connector directly to the wiring harness of the furnace system without any interconnecting harnesses.

19. The method of claim 17, wherein the furnace controller includes a user interface, the method further comprising selecting one of a plurality of I/O pin configurations using the user interface, wherein at least one of the I/O pin configurations corresponds to one of a plurality of furnace system manufactures' default wiring harness configurations.

20. The method of claim 17, wherein each of the harness connectors is a main harness connector and the wiring harness of the furnace system is a main wiring harness, the furnace system further including a secondary wiring harness and the controller further including a plurality of secondary harness connectors, the method further comprising:

connecting only one of the secondary harness connectors to the secondary wiring harness to electrically connect the control circuit to the ignition device.

21. The method of claim 20, wherein the furnace controller further includes a user interface, the method further comprising selecting, using the user interface, one of a plurality of ignition device voltages to be supplied to the ignition device by the controller.

22. The method of claim 17, wherein the furnace system further includes an air circulator, the method further comprising:

electrically connecting the air circulator to the controller; and selecting, using the user interface, one of a plurality of circulator control voltages to be output to the circulator by the controller.

* * * * *